US009297165B2

(12) United States Patent
Thorsnes

(10) Patent No.: US 9,297,165 B2
(45) Date of Patent: Mar. 29, 2016

(54) EXTERNAL WALL WITH PLASTER AND PLASTER CARRIER

(75) Inventor: Ola Øystein Thorsnes, Oslo (NO)

(73) Assignee: SELVAAG GRUPPEN AS, Oslo (NO)

( * ) Notice: Subject to any disclaimer, the term of this patent is extended or adjusted under 35 U.S.C. 154(b) by 0 days.

(21) Appl. No.: 14/234,138

(22) PCT Filed: Aug. 17, 2012

(86) PCT No.: PCT/NO2012/050150

§ 371 (c)(1),
(2), (4) Date: Feb. 14, 2014

(87) PCT Pub. No.: WO2013/025111

PCT Pub. Date: Feb. 21, 2013

(65) Prior Publication Data

US 2014/0245684 A1 Sep. 4, 2014

(30) Foreign Application Priority Data

Aug. 18, 2011 (NO) ..... 20111136

(51) Int. Cl.
*E04B 9/00* (2006.01)
*E04F 13/02* (2006.01)
(Continued)

(52) U.S. Cl.
CPC . *E04F 13/02* (2013.01); *E04B 1/74* (2013.01); *E04F 13/04* (2013.01); *E04F 13/047* (2013.01); *E04F 21/08* (2013.01); *E04B 2001/742* (2013.01)

(58) Field of Classification Search
CPC ..... E04F 13/02; E04F 13/068; E04F 13/16; E04F 13/141; E04F 15/102; B29C 70/08; B29C 70/00; B29C 70/30; E04C 2/043; E04C 1/40; B28B 23/0006
USPC ..... 52/443, 445–447, 454, 309.14–309.16
See application file for complete search history.

(56) References Cited

U.S. PATENT DOCUMENTS 4,558,552 A * 12/1985 Reitter, II ..... 52/745.19
4,578,915 A * 4/1986 Schneller ..... 52/309.12
(Continued)

FOREIGN PATENT DOCUMENTS

DE 3444815 A1 12/1986
FR 2559184 A1 8/1985
(Continued)

OTHER PUBLICATIONS

International Preliminary Report on Patentability, Chapter I dated Sep. 12, 2013 from PCT/NO2012/050150 entitled "External wall with plaster and plaster carrier" filed on Aug. 17, 2012 in the name of Ola Thorsnes, 17 pages.

*Primary Examiner* — Brian Glessner
*Assistant Examiner* — Gisele Ford
(74) *Attorney, Agent, or Firm* — Oppedahl Patent Law Firm LLC

(57) ABSTRACT

A method for applying plaster to an external wall (1), wherein a plaster carrier in the form of plates (2) is attached to a lathwork or corresponding spacer elements (8, 14) on the external side of the wall (1), whereupon the plaster is applied in a substantially continuous surface extending over joints (9, 13) between the plates (2). For the plaster carrier, a composite plate (2) is used comprising a central supporting layer (4) of insulating material and an inner and outer reinforced, fire retardant plaster layer (5, 6) on either side of the supporting layer (4). The plaster carrier plates (2) are attached to the wall (1) by means of fastening devices (10) which are inserted through the plaster carrier plates (2) from the outside, a reinforcement (11) is placed over the joints (9, 13) between the plaster carrier plates (2) and at least some of the fastening devices (10), and a finishing plaster layer is applied to said reinforcement (11) and the outer plaster layer (6).

13 Claims, 3 Drawing Sheets

(51) Int. Cl.

| | |
|---|---|
| ***E04F 13/04*** | (2006.01) |
| ***E04B 1/74*** | (2006.01) |
| ***E04F 21/08*** | (2006.01) |

(56) References Cited

U.S. PATENT DOCUMENTS

| | | | | |
|---|---|---|---|---|
| 4,875,322 | A * | 10/1989 | Rozzi | 52/746.1 |
| 7,882,666 | B2 * | 2/2011 | Karalic | 52/280 |
| 2001/0031336 | A1 * | 10/2001 | Born | B28B 11/003 428/167 |
| 2002/0194805 | A1 * | 12/2002 | Arseneau | E04C 2/296 52/481.1 |
| 2004/0020147 | A1 * | 2/2004 | Martella | E04B 1/14 52/261 |
| 2009/0044476 | A1 * | 2/2009 | Agneloni | 52/443 |
| 2009/0311932 | A1 * | 12/2009 | Hughes | B32B 5/20 442/224 |

FOREIGN PATENT DOCUMENTS

| | | | | |
|---|---|---|---|---|
| GB | 1058396 | | 2/1967 | |
| JP | 2005336823 | * | 12/2005 | E04B 1/70 |
| WO | 2009120092 | A1 | 10/2009 | |

* cited by examiner

EXTERNAL WALL WITH PLASTER AND PLASTER CARRIER

It is known to apply external plaster on relatively expensive interspaced cement and foam plastic based plate materials. Such plaster layers are built up from the bottom with a plurality of layers of plaster and reinforcement. This requires substantial work at the building site and leads to high costs. Furthermore, applying plaster to only one side of the plates may lead to aching due to an inhomogeneous and non-symmetric structure of the plate and plaster layers. If the cavity behind the plates is open and surfaces are combustable, such solutions will be unlawful for fire technical reasons, particularly for tall buildings. An example of the above-mentioned prior art can be found in WO 2009/120092.

The present invention remedies these drawbacks: In a factory a product is produced having an inexpensive central plaster carrier made of expanded polyurethane or a similar thermal insulating material. On one side of the plaster carrier, a thin fire retardant plaster layer is applied with a reinforcement fabric made of alkali resistant fiber. On the other side a corresponding reinforced plaster layer is applied. This plaster layer may be thicker than the one on the other side. This product will have the appearance and properties of a fire resistant rigid plate.

On the outside of a new or old wall, said plate composite is mounted on a lathwork, with the optionally thicker plaster layer facing the wall, and is fastened by fastening devices as for instance screws, nails or cramps. The plate joints are reinforced with strips of reinforcement fabric with alkali resistant fibers so that the reinforcement fabric on either side of the joint are interconnected. On the external side, a finishing plaster layer is applied and covers joints, strips of reinforcement fabric and plates, so that the wall surface appears and functions as a whole without joints. The plaster layer on the external sides which is applied on top of the thin reinforced plaster layer, will have properties corresponding to the thick plaster layer facing the house wall.

Arching caused by varying temperature and moisture content will be eliminated or substantially less than if the inside did not have the reinforced plaster layer. This is because the plaster and reinforcement fabric has a considerably higher module of elasticity and a substantially lower thermal expansion than a pure plaster carrier of for instance polyurethane.

Strength and stability against mechanical stress from the outside will increase substantially because the inner reinforced plaster layer will absorb tensile forces with little fiber stretching without the sheer stresses in the relatively weaker plaster carrier being exceeded. Correspondingly, the outer plaster layer will absorb compressive forces under mechanical loads.

Plates with plaster and reinforcement fabric are produced in a factory in a more or less automated process. Only the outermost plaster layer with strips of reinforcement fabric over the joints is applied at the building site. Costly and time consuming work at the building site is thereby reduced to a minimum, and the total product becomes inexpensive.

The invention is more closely defined in the claims. Here, claim 1 relates to a method for applying plaster to an external wall, claim 7 relates to a plaster carrier for use in applying plaster to a external wall, and claim 9 relates to an external wall provided with a plaster according to the invention.

For a better understanding of the invention, it is to be further described in the following with reference to the appended drawings, where FIG. 1 shows a vertical section through an outer wall with plaster and a plaster carrier according to the invention;

Figure 1:
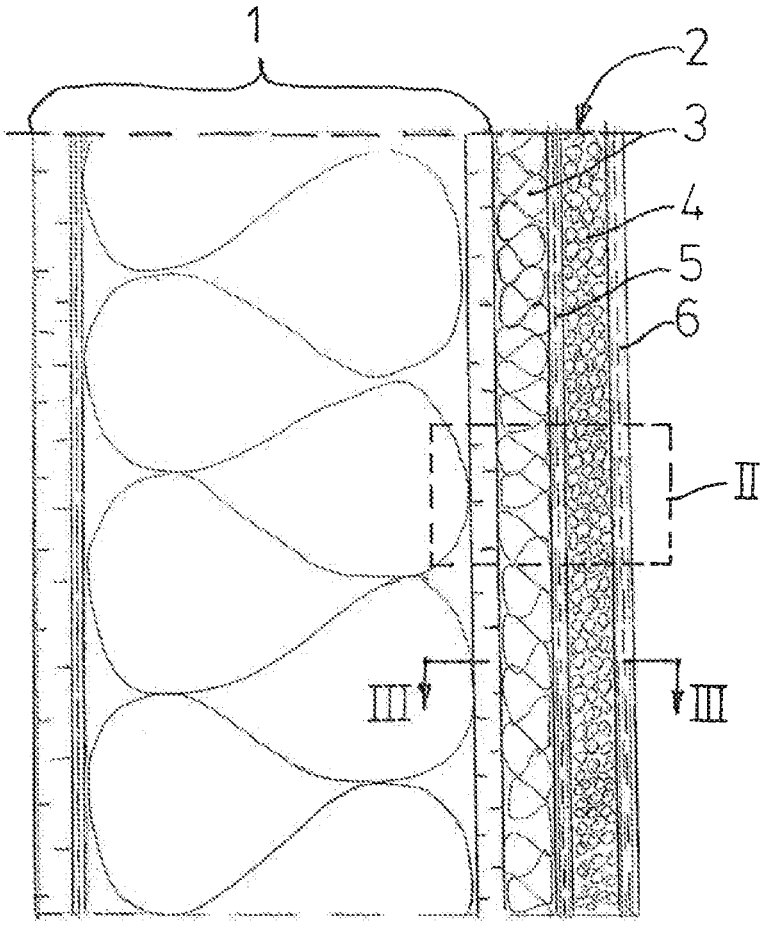

The wall structure shown in FIG. 1 comprises an ordinary wall 1 of a common type. A plaster carrying plate 2 is attached to the external side of the wall by means of laths or corresponding spacers (not shown). The cavity 3 between the wall 1 and the plate 2 may be open, or it may be filled with an insulating and draining material as suggested by the figure. The plate 2 comprises a central carrying layer 4 of insulating material, an inner reinforced, non-combustible plaster layer 5, and an external reinforced, non-combustible plaster layer 6.

Figure 2:
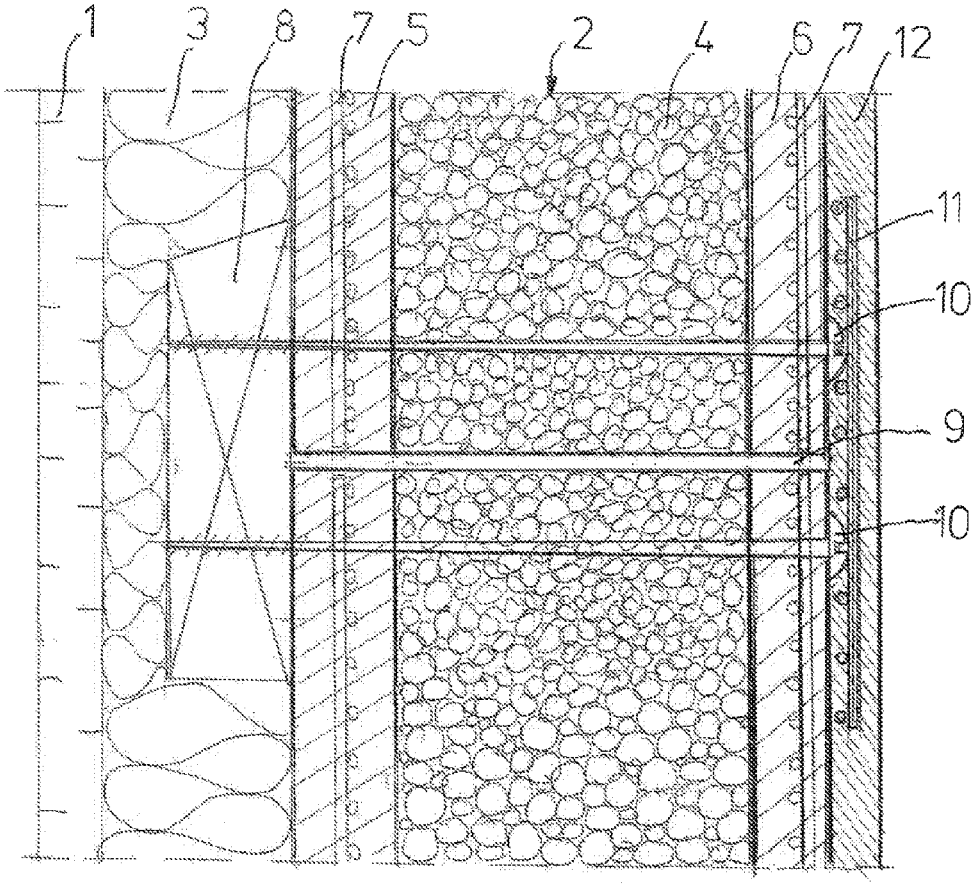
FIG. 2 shows the section II in FIG. 1 at a larger scale.

Further details of the arrangement according to the invention will appear from the vertical section shown in FIG. 2. It will be seen that the plaster layers 5 and 6 has a reinforcement 7, which can have any suitable form and preferably is constituted by a reinforcement fabric of alkali resistant fibers. Shown is also an element 8 of a lathwork for the attachment of two composite plates 2 in the area of a horizontal joint therebetween. The composite plates 2 are attached to the element 8 by means of screws 10, but other attachment means can also be used, for instance nails or cramps.

Since the cavity 3 in this case is filled with insulating material, such as mineral wool which is vapor open and draining, any condensation or leakage water will not collect at this point, but find its way downwards in the structure. In order for such water not to be hindered by the lathwork element 8, its upper surface is slanted and its thickness is less the width of the cavity 3. When the cavity 3 is filled by insulating material, the insulating capacity in the central structural layer 4 of the composite plate 2, together with the insulation in the cavity 3, may be added to the insulating capacity of the wall 1 and make it possible to reduce the total thickness of the wall as compared to an ordinary interspaced wall. This allows for a larger commercial net area of the building. With the cavity filled, any fire gases are prevented from rising upwards in the cavity, and fire stoppers for each floor may be omitted. The prerequisite for filling the cavity 3 with insulating material is that the cavity is drained at the bottom to prevent any condensation or leakage water from collecting there, and that the cavity is vapor open at the top of the cavity to let overpressure water vapor escape from the cavity.

After the composite plates having been screwed to the element 8, which may consist of wood or metal, joints between the plates, such as the joint 9, are reinforced with strips 11 of reinforcement material such as reinforcement fabric having alkali resistant fibers, so that the reinforcement fabrics on either side of the joint are connected.

On the outside of the composite plate a finishing plaster layer 12 is applied, which in itself can comprise reinforcement and several layers of plaster, whereof the outermost one may be colored.

Figure 3:
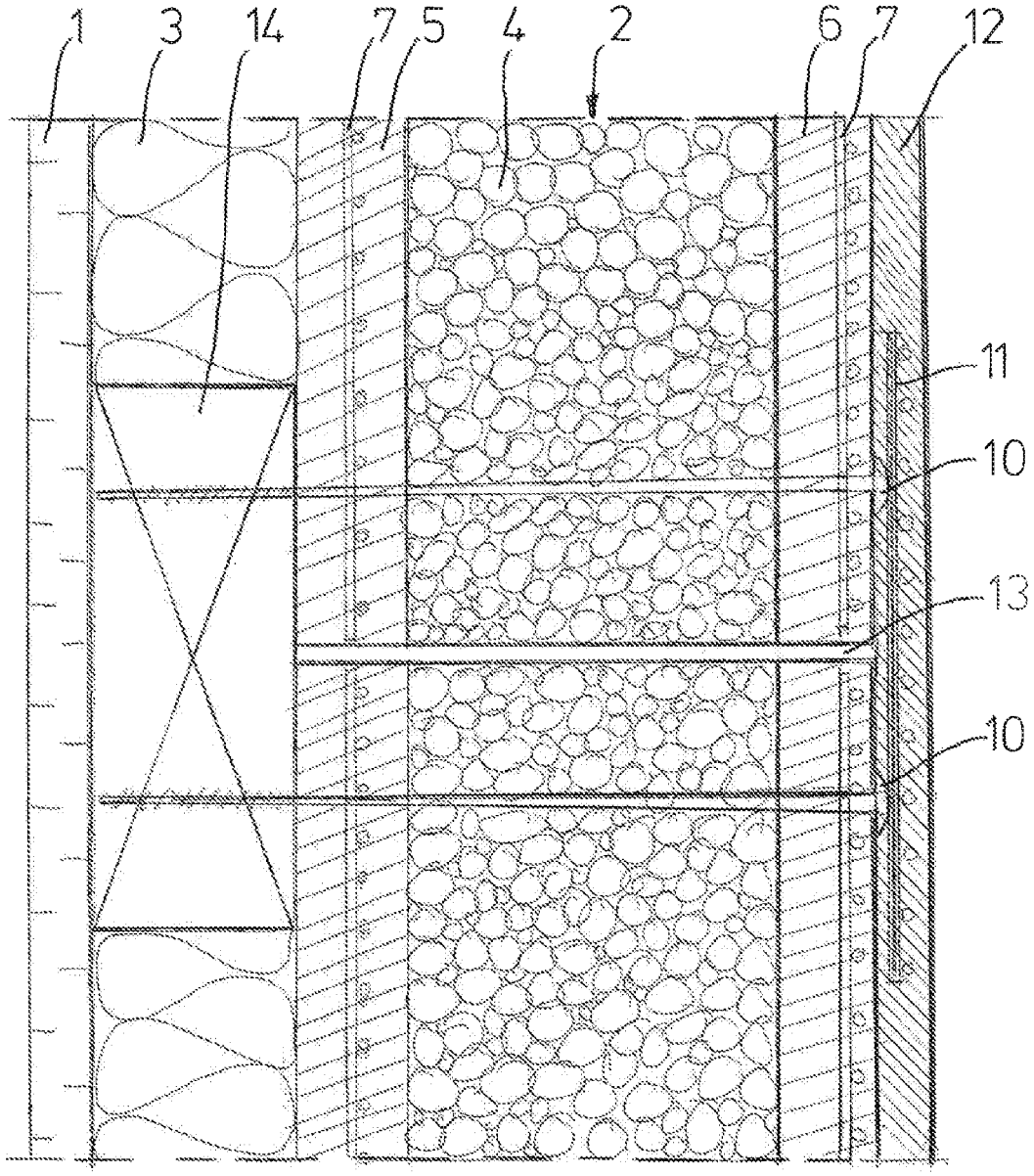
FIG. 3 shows a horizontal section along the line III-III in FIG. 1 at the same scale as FIG. 2.

FIG. 3 shows a horizontal section in the area of a vertical joint 13 between two composite plates 2. The plates are anchored in a vertical fastening 14 made of wood or metal, which also serves as a spacer element. The other constituents are as in FIG. 2.

The composite plates 2 are produced in a factory under controlled conditions which gives uniform and good quality in the various constituent parts. The composite plate can therefore be made sufficiently strong without being heavy and difficult to handle. Thus, the thickness of the inner and outer plaster layers 5, 6 may be from 3 to 5 mm. The central supporting layer 4 of insulating material can have a thickness of 10 to 30 mm, preferably about 15 mm. The finishing plaster layer 12, which is the only one that has to be applied at the building site, will usually have a thickness of 3 to 10 mm.

It will be understood that the invention is not limited to the exemplifying embodiment described in connection with the drawings, but that the invention may be varied and modified by the skilled person within the frame of the following claims. For instance, the dimension ranges indicated above may be deviated from if indicated by material properties or special functional requirements.

The invention claimed is:

1. A method for applying plaster to an external wall (1) having an outside, comprising the steps of:

attaching a plaster carrier in the form of a plurality of plates (2) to the outside of the external wall (1) at least partly by means of fastening devices (10) which are inserted through each of said plurality of plaster carrier plates (2) from the outside, applying the plaster in a substantially continuous surface which extends over joints (9, 13) between adjacent plates (2), wherein each of said plurality of plaster carrier plates (2) comprises a central layer (4) of thermally insulating material and an inner and an outer reinforced, fire retardant plaster layer (5, 6) on an inner and an outer side of the central layer (4), respectively, placing reinforcement (11) over joints (9, 13) between the adjacent plaster carrier plates (2), and applying a finishing plaster layer (12) to said reinforcement (11) and the outer plaster layer (6), characterized by providing an expanded polyurethane material for the thermally insulating material in each of said plurality of plaster carrier plates (2), attaching each of said plurality of plaster carrier plates (2) to a lathwork or corresponding horizontally and vertically extending spacer elements (8, 14) on the outside of the external wall (1), inserting the fastening devices (10) on both sides of the joints (9, 13) between the adjacent plaster carrier plates (2) and covering the fastening devices with the reinforcement (11) before applying the finishing plaster layer (12), and filling a space (3) delimited by the outside of the external wall (1), the spacer elements (8, 14) and each of said plurality of plaster carrier plates (2) with insulating material.

2. The method according to claim 1, further comprising the step of using a reinforcement fabric with alkali resistant fibers to reinforce said inner and outer layers (5, 6).

3. The method according to claim 1 further comprising the step of reinforcing the joints (9, 13) with strips of reinforcement fabric with alkali resistant fibers.

4. The method according to claim 1 further comprising the step of providing the inner plaster layer (5) with a larger thickness than the outer plaster layer (6).

5. The method according to claim 1 further comprising the step of providing at least some of the horizontally extending spacer elements (8) with a sloping top surface and smaller thickness than the distance between the outside of the external wall (1) and the plaster carrier plate (2) for permitting drainage of condensation or leakage water.

6. The method according to claim 3 further comprising the step of using a reinforcement fabric with alkali resistant fibers to reinforce said inner and outer layers (5, 6).

7. The method according to claim 3 further comprising the step of providing the inner plaster layer (5) with a larger thickness than the outer plaster layer (6).

8. The method according to claim 3 further comprising the step of providing at least some of the horizontally extending spacer elements (8) with a sloping top surface and smaller thickness than the distance between the outside of the external wall (1) and the plaster carrier plate (2) for permitting drainage of condensation or leakage water.

9. A plaster carrier for use in applying a finishing plaster layer (12) to an external wall (1), the carrier comprising:

a plate of insulating material for attachment to a lathwork or spacer elements (8, 14) on an outside of the external wall (1) and for subsequent application of a finishing plaster layer (12), wherein the plate is a composite plate (2) which comprises a central supporting layer (4) of a thermally insulating expanded polyurethane material having an inner and an outer side and an inner and an outer reinforced, fire retardant plaster layer (5, 6) on the inner and outer sides of the supporting layer, respectively, wherein the inner plaster layer (5) has a larger thickness than the outer plaster layer (6), the outer plaster layer being intended for application of the finishing plaster layer (12), and wherein said inner and outer plaster layers (5, 6) are reinforced with a reinforcement fabric having alkali resistant fibers.

10. A plaster carrier for use in applying plaster to an external wall (1), comprising a plate for attachment to the external wall (1) and for subsequent application of a finishing plaster layer (12), wherein the plate comprises a central layer (4) of thermally insulating material and an inner and an outer reinforced plaster layer (5, 6) on an inner and an outer side of the central layer, respectively, characterized in that the inner plaster layer (5) has a larger thickness than the outer plaster layer (6), the outer plaster layer being intended for application of the finishing plaster layer (12), wherein the thermally insulating material is an expanded polyurethane material, and wherein the inner and outer plaster layers (5, 6) are reinforced with a reinforcement fabric having alkali resistant fibers.

11. An external wall (1) having an outside and comprising an isolated supporting structure and an external plaster (12) applied using a method wherein a plaster carrier in the form of a plurality of plates (2) is attached to the outside of the external wall (1) at least partly by means of fastening devices (10) which are inserted through each of said plurality of plaster carrier plates (2) from the outside, whereupon the plaster is applied in a substantially continuous surface which extends over joints (9, 13) between adjacent plaster carrier plates (2), wherein the each of said plurality of carrier plates comprises a central layer (4) of thermally insulating material and a reinforced, fire retardant plaster layer (5, 6) on both sides of the central layer (4), wherein reinforcement (11) is placed over the joints (9, 13) between the adjacent plaster carrier plates (2), and wherein a finishing plaster layer (12) is applied to said reinforcement (11) and the plaster carrier, characterized in that an expanded polyurethane material comprises the thermally insulating material in each of said plurality of plaster carrier plates (2), wherein each of said plurality of plaster carrier plates (2) is attached to a lathwork or corresponding horizontally and vertically extending spacer elements (8, 14) on the outside of the external wall (1), wherein fastening devices (10) are inserted on both sides of the joints (9, 13) between the adjacent plaster carrier plates (2) and are covered with the reinforcement (11) before the finishing plaster layer (12) is applied, and wherein a space (3) delimited by the outside of the external wall (1), the spacer elements (8, 14) and each of said plurality of plaster carrier plates (2), is filled with insulating material.

12. An external wall according to claim 11, wherein the plaster layer (5) on one side of the thermally insulating material has a larger thickness than the plaster layer (6) on an other side, wherein other side the finishing plaster layer (12) is applied to said other side.

13. An external wall according to claim 11, wherein the plaster layers (5, 6) are reinforced with a reinforcement fabric having alkali resistant fibers.

* * * * *